US008945685B2

(12) United States Patent
Tuma et al.

(10) Patent No.: US 8,945,685 B2
(45) Date of Patent: Feb. 3, 2015

(54) METHOD FOR DYING AND/OR PRINTING ADHESIVE CLOSURE PARTS

(75) Inventors: Jan Tuma, Herrenberg (DE); Konstantinos Poulakis, Hildrizhausen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 552 days.

(21) Appl. No.: 12/733,745

(22) PCT Filed: Oct. 10, 2008

(86) PCT No.: PCT/EP2008/008564
§ 371 (c)(1), (2), (4) Date: Mar. 18, 2010

(87) PCT Pub. No.: WO2009/065466
PCT Pub. Date: May 28, 2009

(65) Prior Publication Data

US 2010/0239780 A1 Sep. 23, 2010

(30) Foreign Application Priority Data

Nov. 20, 2007 (DE) ..... 10 2007 055 428

(51) Int. Cl.

| | |
|---|---|
| ***B05D 3/06*** | (2006.01) |
| ***B41M 1/40*** | (2006.01) |
| ***A44B 18/00*** | (2006.01) |
| ***B41M 5/00*** | (2006.01) |
| ***D06P 5/20*** | (2006.01) |

(Continued)

(52) U.S. Cl.
CPC ..... *A44B 18/0069* (2013.01); *B41M 5/0011* (2013.01); *D06P 5/2016* (2013.01); *D06P 5/30* (2013.01); *B41M 7/00* (2013.01); *B41M 7/0081* (2013.01); *B41M 7/009* (2013.01)
USPC ..... 427/553; 427/301; 427/422; 427/557

(58) Field of Classification Search
CPC .. B05D 3/0263; B05D 3/061; B05D 2350/00; B05D 2350/30; B05D 2350/60
USPC ..... 427/301, 355, 422, 466, 510, 514, 256, 427/553, 557
See application file for complete search history.

(56) References Cited

U.S. PATENT DOCUMENTS 4,889,761 A * 12/1989 Titterington et al. ..... 428/32.1
5,380,769 A * 1/1995 Titterington et al. ..... 523/161
5,756,692 A * 5/1998 Gregory et al. ..... 534/796

(Continued)

FOREIGN PATENT DOCUMENTS

DE 698 13 177 T2 3/2004
EP 1 010 802 A2 6/2000

(Continued)

*Primary Examiner* — Elena T Lightfoot
(74) *Attorney, Agent, or Firm* — Roylance, Abrams, Berdo & Goodman LLP

(57) ABSTRACT

A method for dying and/or printing adhesive closure parts (10) having a plurality of hooks (12) predominately made of a plastic material connected to a carrier (14), applies a dye medium to the surface (16) of the adhesive closure part (10) or its parts by an application unit (18). Because the dye used is based on a solvent free wax applied by the application unit (18) in a melted form in droplets, bubbles, or pellet form, and enters into a fixed connection to the surface (16) in the cooled, cured state, a wax dye application may be achieved that is markedly colorfast and UV resistant.

10 Claims, 1 Drawing Sheet

(51) Int. Cl.
*D06P 5/30* (2006.01)
*B41M 7/00* (2006.01)

(56) References Cited

U.S. PATENT DOCUMENTS

| | | | | |
|---|---|---|---|---|
| 5,887,238 | A * | 3/1999 | Matsuzoe et al. | 399/336 |
| 6,106,602 | A * | 8/2000 | Ouchi et al. | 106/31.61 |
| 6,410,099 | B1 * | 6/2002 | Loncar, Jr. | 427/466 |
| 6,500,510 | B1 * | 12/2002 | Sanders et al. | 428/64.1 |
| 6,910,353 | B2 | 6/2005 | Sasser et al. | |
| 2005/0256477 | A1 | 11/2005 | Van Gompel et al. | |
| 2006/0142554 | A1 | 6/2006 | Egli | |
| 2008/0184911 | A1 * | 8/2008 | Banning | 106/31.29 |

FOREIGN PATENT DOCUMENTS

| | | | |
|---|---|---|---|
| EP | 1 502 988 | A1 | 2/2005 |
| GB | 2 168 653 | A | 6/1986 |
| JP | 07-213310 | A | 8/1995 |
| WO | WO 98/30643 | A1 | 7/1998 |
| WO | WO 98/39759 | A1 | 9/1998 |

* cited by examiner

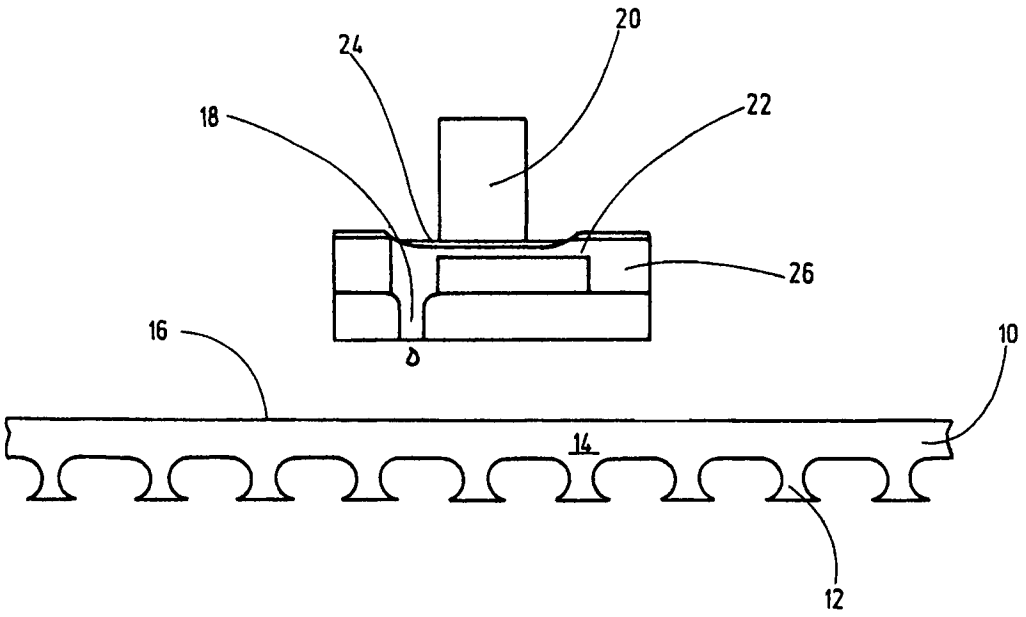
20
24
22
18
26
D
10
14
16
12

METHOD FOR DYING AND/OR PRINTING ADHESIVE CLOSURE PARTS

FIELD OF THE INVENTION

The invention relates to a method for dyeing and/or printing adhesive closure parts having a plurality of interlocking members connected to a backing, primarily consisting of a plastic material. A dye medium is applied to the surface of the adhesive closure part or its parts by an applicator.

BACKGROUND OF THE INVENTION

Tape-like adhesive or touch-and-close closure parts are readily available on the market in a plurality of embodiments. The known adhesive closures generally have two parts in the form of male or female engagement parts. The male engagement parts are formed from a hook-shaped or mushroom-shaped closure material as interlocking parts on which female engagement parts in the form of a hook or fleece material can be fastened, if the two engagement parts are connected to one another with the formation of the actual adhesive closure. These interlocking parts can be repeatedly detached from one another and connected to one another. The primary applications for these adhesive closures are generally in the clothing industry. They are also the subject matter of technical applications, for example, as fasteners for wall and panel linings in motor vehicles and the like.

The tape-like adhesive closures can be obtained in one piece from plastic material by conventional forming processes. However, at least parts of these adhesive closures can be obtained by weaving and/or knitting from a plastic fiber material. The plastic material used is generally colorless or has a dyed basic shade originating from the extrusion process. This coloring generally makes it difficult to adapt the finished adhesive closure products to color factors, as arise, for example, from fabric colors in the clothing and textile industry. In particular, when only small numbers of adhesive closures of a specific color are required, it poses problems for the manufacturer to set up the entire production process for a small batch with a definable color of the plastic material.

To remedy this situation, EP 1 502 988 A1 suggests dyeing and/or printing adhesive closure parts formed mainly of plastic material by dye application nozzles. The ejection of solvent-containing dye is triggered by a piezo crystal. In this way, very small dye volumes, in the pictoliter range, can be applied in droplets with a very high application frequency to the respective engagement part of the adhesive band closure. Proceeding from a colorless, preferably transparent base material or one with basic dyeing, dyeing tasks can be performed within a wide scope. Depending on the chosen dye, small numbers of engagement parts can be treated in terms of dye and configuration. Furthermore, a specific dye pattern can be implemented on the engagement part with the respective dye application nozzle to apply characters of number or letter sequences. In particular, with the known solutions, dye or print small production amounts of closure material are possible without the remaining production process for the engagement parts.

In the known solution, the dyes applied are inks, in particular reactive inks, acid inks, or dispersion inks. These inks contain solvents so that they are not especially suitable for marking of adhesive closure parts used in the food, cosmetics and pharmaceutical domain. Especially in very long lasting operations with numerous washing processes, the ink used fades, reducing the clarity of the ink coating with time and leading to an unattractive appearance. The inks are often not lightfast and fade accordingly strongly upon exposure to solar radiation.

WO 98/39 759 A1 discloses a method in which for dyeing and/or printing of adhesive closure parts solvent-based inks, curable inks and water-based inks are used as the dye medium. In U.S. Pat. No. 6,910,353 B2, for a comparable application, water-based inks with acrylate binders are used and are applied by flexographic printing methods. DE 698 13 177 T2 discloses using solvent-free waxes in the form of hot melt ink compositions for printing of porous substrates for producing bar codes.

SUMMARY OF THE INVENTION

An object of the invention is to provide an improved method for dyeing and/or printing of adhesive closure parts, while maintaining the prior art advantages, such that the closure parts remain lightfast in long-term operation and that increased environmental and health requirements are taken into consideration.

This object is basically achieved by a method where the dye medium is one based on a solvent-free wax applied in molten form in droplet, bubble, or pellet form by an applicator. In the cooled, set state, the solvent free wax bonds tightly to the surface of the adhesive closure part, as well as to its parts. In terms of process engineering, even extremely small numbers of adhesive closure parts can be reliably dyed or printed. This dye application has proven particularly wash-resistant and UV-resistant, even after very long intervals of use.

The method according to the invention, within the scope of wax application, manages without solvents. In critical domains such as the food industry, the pharmaceutical or cosmetics industry, for special products such as inserted packages, an adhesive closure part dyed with wax can then be easily used. Proceeding from a preferably colorless, transparent plastic material or a plastic material with basic dyeing, dyeing tasks can be performed by wax application within a widely drawn framework. Wax application is very reliable and is economically efficient to treat even small numbers of adhesive closure parts in terms of dye and configuration. In addition to application of a dye pattern design, the application waxes can also be applied in the form of number or letter sequences so that respective manufacturer data, production information, or the like can be applied to the adhesive closure part.

The applicator for the colored wax is preferably at least one wax application nozzle. The ejection of the wax is triggered by a piezo crystal. In this way, very small wax volumes in the pictoliter range can be applied in droplets with a very rapid application frequency to the adhesive closure part, as well as to its parts. Another option is to hold the colored wax in the form of individual wax rods which are melted in the hardware interior of the applicator and then are supplied to its printing head. The printing heads then spray the application wax in the form of pellets onto the surface of the respective adhesive closure part. In this application method, the colored wax, upon striking the adhesive closure part, is already almost solid again. This procedure has the advantage that, in particular for weave-like adhesive closure parts of individual filaments, the wax does not penetrate completely into the fabric such as to fade.

Another application option is to heat the colored wax rapidly to its vaporization temperature (>300° C.) with the result that the wax forms bubbles which in turn collapse and which, in this case, can be explosively ejected out of an application nozzle. This process can be repeated up to 10,000 times per second. In this way, a high quality printing process for the respective adhesive closure part can also be achieved. However, the piezo application technology mentioned initially has proven to be the most easily managed. The colored application wax dries in fractions of a second on the surface of the adhesive closure part so that any afterdrying or subsequent curing processes are not necessary. This process in turn increases the process speed.

In one preferred embodiment of the process according to the invention, each colored wax application nozzle is used for a certain color or shade. Mixed dyes can be produced directly on the surface of the adhesive closure part by different wax application nozzles. Mixed dyes can be supplied directly to the product by the respective wax application nozzle and to dye it in this way. To obtain high dyeing or printing rates, a plurality of wax application nozzles, preferably, the wax application nozzles, are located stationary in the applicator and the adhesive closure parts to be dyed or printed are routed with a definable speed through the application device and are provided with the dye coating by means of the wax application nozzles.

Plastic materials which can be easily dyed can be acrylates, as well as conventional polyamide, polyester, polyethylene, and polypropylene materials from which otherwise the interlocking means of the tape-like adhesive closure part are obtained produced in one piece as a cast product or by way of conventional knitting-weaving methods.

In a development of the method according to the invention, preferably wax application nozzles are on the two opposing surfaces of the adhesive closure part. In this way a dyeing or printing process can take place from two different sides, optionally, with different waxes and dyes. Especially advantageous, before the actual dyeing or printing with the wax, supplying the adhesive closure parts to reactive pretreatment for surface coating or surface functionalization increases the depth of color.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawing which forms a part of this disclosure and which is schematic and not to scale:

FIG. 1 is a side elevational view of the essential components of a wax application nozzle for dyeing a tape-like adhesive closure part with male engagement parts in the form of mushroom-like interlocking parts, wax application taking place on the rear surface of the adhesive closure part, according to an exemplary embodiment of the invention.

DETAILED DESCRIPTION OF THE INVENTION

The method according to an exemplary embodiment of the invention is used to dye and/or print adhesive closure or touch-and-close parts 10, FIG. 1, with male interlocking parts 12 having mushroom-shaped interlocking heads as integral components of the tape-shaped backing 14 for the adhesive closure part 10. The mushroom-shaped interlocking elements 12 can be joined to a corresponding hook or fleece material as female engagement parts with the formation of an adhesive closure system (not shown). The hook or fleece material detachably interlock on the edge-side projections of the interlocking elements 12. A production process for these engagement parts is described, for example, in EP 1 309 257 B1. The adhesive closure part in this respect is formed of a plastic material cast in a screen, for example, in the form of polyethylene in a colorless configuration and almost transparent or the plastic material is provided with a basic color as results from the plastic granulate, from which the adhesive closure part 10 can be produced by way of the known extrusion method. Instead of the adhesive closure part 10 cast in a chill-roll method, it can also be a woven or knit basic backing structure from which the interlocking parts (hooks, mushrooms, loops, etc.) then protrude with a definable projection (not shown).

If, at this point, the intention is to dye or print the pertinent, preferably tape-like adhesive closure part 10, it is not sufficient, to handle the plurality of formation tasks, to dye the plastic granulate beforehand, that is, prior to producing the actual adhesive closure part 10. It is preferable to dye and print the already produced adhesive closure part of plastic material later, especially, if only small numbers (tapes less than 1 m long) of the adhesive closure part 10 with a specific coloring are needed, for example for use in the clothing or packaging industry. In the present case, as shown in FIG. 1, the back surface 16 of the adhesive closure part 10 is dyed or printed accordingly.

To meet the aforementioned requirements, the method according to the invention calls for dyeing and/or printing of the adhesive closure part 10 by at least one wax application nozzle 18. The ejection of colored wax by the wax application nozzle 18 is triggered by a piezo crystal 20. This ejection of colored wax is in the pictoliter range per triggering cycle of the piezo crystal 20. Since, as is recognized, the piezo crystals 20 have very high vibration frequencies, a small application amount is still sufficient to achieve full colored wax application. Depending on the plastic material used for the adhesive closure part 10, the applied wax coating can at least partially penetrate slightly into the plastic material on the surface side and, in this way, to saturate the open pores of the plastic material with colored wax.

For the sake of simpler representation, FIG. 1 shows only one wax application nozzle 18. For a definitive dyeing or printing process, a plurality of nozzles is necessary. Several colored wax application nozzles 18, for example 100 to 200, can be accommodated in one printing head of the overall applicator. With 10 to 20 of the piezo-triggered pressure heads, a high passage rate, in addition to full colored wax application for the adhesive closure part 10 to its rear surface 16, can be achieved with very high printing speeds. Depending on the selected triggering for the piezo crystals 20, dyeing processes, as well as providing the respective adhesive closure part 10 with a printing pattern, even in the form of an advertizing message, company name imprint, or the like can be undertaken. Instead of the illustrated adhesive closure part 10, one with hook-shaped closure heads or a female engagement part in the form of a conventional loop closure material (not shown) can be colored. These engagement parts can also be obtained by weaving processes.

Instead of treating the rear surface of the adhesive closure part 10, the color coating by the coating wax can be provided on the opposite top side in the region of the free face sides of the interlocking puts 12. This treatment also applies to the stem material or the free distances between the mushroom-like adhesive closure parts 12. An especially attractive, undistorted design arises by rearward printing according to the exemplary embodiment as shown in FIG. 1.

The dye application nozzle 18 shown in FIG. 1 is designed overall as a capillary nozzle and is connected to a pressure chamber 22 to carry fluid. On the top side of pressure chamber 22, a vibration plate 24 acts and can be triggered by the piezo crystal 20. On the piezo crystal 20, positive and negative voltages are applied to control the wax delivery. If there is no voltage on the piezo crystal 20, the colored wax originating from a storage chamber (not shown) flows via a supply line 26 into the pressure chamber 22. If, at this point, a positive voltage is applied to the piezo crystal 20, the crystal presses on the colored wax in the pressure chamber 22 by way of the vibration plate 24 and ejects the colored wax through the capillary nozzle 18 onto the rear surface of the adhesive closure part 10. By applying a negative voltage to the piezo crystal 20, the vibration plate 24 moves suddenly back, causing the application of colored wax to be abruptly interrupted. The delivered amount of wax can be very precisely metered by the extremely fast voltage change so that, with this application method, resolutions from 100 to 9600 dpi, preferably up to several 10,000 dpi can be achieved. This process results in very good printing and wax color quality.

The dyeing and printing method by colored wax can be operated more or less continuously. Originating from the production machine, the adhesive closure part 10 can be continuously routed through under the colored wax applicator. By triggering of the piezo crystals 20 and by a suitable choice of the wax colors, the dyeing and printing design can be changed during the passage process. Especially advantageously, the colored waxes to be applied are those free of solvent. Colored waxes can be used which can preferably be kneaded at 20° C. and which otherwise occur solid to brittle-hard. The wax used should have a coarse to finely crystalline structure and should be transparent to opaque to colors in its color formation, but should not be vitreous. Above 40° C., the colored wax used should melt without decomposing and should be slightly liquid just above the melting point, that is, less viscous. In particular, a highly temperature-dependent consistency and solubility have proven favorable. If the colored wax used can be polished under slight pressure, this ability enables an aftertreatment possibility in which the surface configuration of the wax can be modified. For example, the wax applied to the adhesive closure part appears shiny. For purposes of aftertreatment, the wax can be fixed, for example, by the applied wax being additionally fixed later with steam and/or with an alkali-containing cold bath and/or by mechanical treatment, for example, by a pressing calander pressing on the waxed surface of the adhesive closure part 10. Furthermore, aftertreatment can also be done by IR or UV light or by application of intrinsic energy. In addition, it is possible to aftertreat the final product by means of actinic energy.

In order to achieve especially good adhesion of the respective colored wax used on the assignable surface of the adhesive closure part 10, before actually applying the colored wax, a process for surface functionalization of the adhesive closure part 10 should be carried out beforehand. In particular, by a proton and/or electron exchange medium, especially in the form of donors or collectors, the surface energy of the adhesive closure part 10 can be modified using high energy such that the chemical physical properties of the adhesive closure material without coating and resistant to ageing can be set by function groups of the exchange medium attaching to the adhesive closure part material. This attachment process of the function groups to the coating wax can be supported by a high energy flow, for example, by using high frequency radiation, electrical fields, such as that of a dielectric barrier discharge, or by plasma-supported fields. Proton and/or electron exchange media, in particular, are substances and groups of substances according to the following list:

$F^-$, $Cl^-$, $N_3^-$, $Br^-$, etc.

These exchange media interact especially well with the plastic material for the respective adhesive closure part 10 to be produced, if the plastic material belongs to one of the following groups: polyethylenes, polypropylene, polybutenes, as well as polyisobutenes and poly(4-methyl-1-penten(es), polymers of the higher α-olefins, for example poly(1-hexene), poly(1-octene), or poly(1-octadecene). Copolymers from different olefins, for example those from ethylene with propylene, should also be recognized as belonging to these polyolefins. A further good feedstock for the adhesive closure parts to be produced is polyester. If the plastic material used at the time is surface-functionalized with the proton and/or electron exchange medium, especially good bonding of the respective charge wax with the surface 16 of the adhesive closure part 10 can be expected. The change of the surface energy obtained in this way for the adhesive closure part 10 takes place within the surface 16 and is not represented as a coating.

Another approach to surface activation for the plastic material of the adhesive closure part 10 is to actually apply a coating to the surface 16, for example, in the form of fluorine. Fluorine application has proven particularly favorable for later adherence of the colored wax on the adhesive closure part 10. By using fluorine, some of these plastics for the adhesive closure part 10 are affected on their surface. Using this effect, the surface 16 of the adhesive closure part 10 for attachment with the colored wax can be modified under controlled conditions. To enhance color depth, the surface 16 can be delivered to reactive cationic pretreatment for purposes of surface modification or, in addition, hydrotropic substances be applied.

With the method according to the invention even extremely small numbers of adhesive closure parts 10 can be reliably and permanently dyed or printed with the colored wax. This colored wax coating or charge has proven especially wash-resistant and UV-resistant even in long-term operation.

While one embodiment has been chosen to illustrate the invention, it will be understood by those skilled in the art that various changes and modifications can be made therein without departing from the scope of the invention as defined in the appended claims.

What is claimed is:

1. A method of at least one of dyeing and printing an adhesive closure part, comprising the steps of:

applying a molten dye medium to a surface of a plastic adhesive closure part having a plurality of interconnecting parts connected to a backing, the dye medium having a solvent-free wax applied in at least one of droplet form, bubble form and pellet form by an applicator;

prior to applying the dye medium to the surface of the adhesive closure part, at least one of functionalizing and coating the surface with an active coating for better adherence of the dye medium; and cooling and solidifying the dye medium to bond the dye medium tightly to the surface, and aftertreating the solvent-free wax applied to the surface by applying at least one of actinic energy, UV light and IR light applied to the solvent-free wax.

2. A method according to claim 1 wherein during the application of the solvent-free wax by the applicator, the wax strikes the surface in an almost solid or solidified form.

3. A method according to claim 1 wherein the solvent-free wax is kneadable at 20° C., is solid, has a coarse to fine crystalline structure, is not vitreous, melts above 40° C. without decomposing, is slightly liquid and less viscous at a melting point thereof, has a strong temperature-dependent consistency and solubility, and can be polished under slight pressure.

4. A method according to claim 3 wherein the solvent-free wax is an ester of higher, even-numbered fatty acids of C16 to C18 with higher fatty alcohol of C16 to C36.

5. A method according to claim 1 wherein the applicator has at least one application nozzle and ejects the solvent-free wax by action of a piezo crystal.

6. A method according to claim 5 wherein the applicator has a plurality of different application nozzles supplied with different solvent-free waxes applying mixed colors directly on the surface to obtain at least one of a certain color and a shade.

7. A method according to claim 1 wherein the surface applied with the solvent-free wax faces away from the interconnecting parts.

8. A method according to claim 1 wherein said aftertreating is by applying actinic energy to the solvent-free wax.

9. A method according to claim 1 wherein said aftertreating is by applying UV light to the solvent-free wax.

10. A method according to claim 1 wherein said aftertreating is by applying IR light to the solvent-free wax.

* * * * *